US006549737B2

(12) United States Patent
Sano et al.

(10) Patent No.: US 6,549,737 B2
(45) Date of Patent: Apr. 15, 2003

(54) PROCESS UNIT DIVIDED INTO A PLURALITY OF SEPARABLE UNITS AND IMAGE FORMING APPARATUS USING SUCH PROCESS UNIT

(75) Inventors: Isao Sano, Fuji (JP); Hideaki Sugiyama, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/951,880

(22) Filed: Sep. 13, 2001

(65) Prior Publication Data

US 2003/0049045 A1 Mar. 13, 2003

(51) Int. Cl.[7] ..... G03G 21/18
(52) U.S. Cl. ..... 399/111; 399/113
(58) Field of Search ..... 399/111, 113, 399/121

(56) References Cited

U.S. PATENT DOCUMENTS 4,692,018 A * 9/1987 Tamura ..... 399/113
4,757,344 A * 7/1988 Idenawa et al. ..... 399/113
5,266,998 A * 11/1993 Lee ..... 399/113
5,371,575 A * 12/1994 Sekino et al. ..... 399/113 X
6,070,030 A * 5/2000 Fujishiro ..... 399/111
6,298,202 B1 * 10/2001 Fushiya et al. ..... 399/113 X
6,366,749 B1 * 4/2002 Koumoto ..... 399/113

FOREIGN PATENT DOCUMENTS

JP 6-317954 11/1994
JP 9-120251 5/1997

* cited by examiner

*Primary Examiner*—William J. Royer
(74) *Attorney, Agent, or Firm*—Frishauf, Holtz, Goodman & Chick, P.C.

(57) ABSTRACT

A process unit is provided which includes a unit housing having a downwardly opened upper housing and an upwardly opened lower housing. The upper housing and the lower housing are detachably coupled to define a space section. A photosensitive member unit is detachably attached in the upper housing, and a developing device is detachably attached in the lower housing.

7 Claims, 9 Drawing Sheets

PROCESS UNIT DIVIDED INTO A PLURALITY OF SEPARABLE UNITS AND IMAGE FORMING APPARATUS USING SUCH PROCESS UNIT

BACKGROUND OF THE INVENTION

The present invention relates to a process unit, used in an image forming apparatus applying an electrophotographic system.

The image forming apparatus applying the electrophotographic system is equipped with a photosensitive member, a charging device, an exposing device, a developing device, a transferring device and a fixing device, which function to record an image on a recording paper, in an apparatus main body. The charging device electrifies the photosensitive member, and the exposing device exposes the photosensitive member and forms a latent image. The developing device forms a toner image by developing the latent image on the photosensitive member. The transferring device transfers the toner image on the photosensitive member onto the recording paper. The fixing device fixes the toner image on the recording paper.

In general terms, in the image forming apparatus, a process unit is composed of at least a photosensitive member, a charging device and a developing device. There are image forming apparatuses known in the prior-art which adopt the process unit disclosed in Jpn. Pat. Appln. KOKAI Publication No. 9-120251 and the process unit disclosed in Jpn. Pat. Appln. KOKAI Publication No. 6-317954. The former process unit is an integrated unit structure which combines a photosensitive member unit including a photosensitive member, a charging device and a developing device as one unit. The latter process unit is constructed such that a photosensitive member, a charging device and a developing device are directly integrated. In these structures, the whole process unit is integrated as one body, and when the photosensitive member, which is a consumable component, has deteriorated, the whole process unit is removed from the apparatus main body of the image forming apparatus. In short, in these structures, when the photosensitive member is to be replaced, the whole process unit (including not only the photosensitive member which is required to be replaced, but also the charging device and developing device) is replaced.

However, each of the lifetimes of the devices or components, which are included in the process unit, are not equal and are different. Although the lifetime of the photosensitive member is short by being frequently used, the lifetimes of the other devices or components, which are used less than the photosensitive member, are longer.

When the whole process unit is replaced on the basis of the lifetime of the photosensitive member, it is uneconomical to replace other devices or components whose lifetimes have not yet ended and which are still able to be used.

BRIEF SUMMARY OF THE INVENTION

The purpose of the present invention is to provide a process unit which enhances the cost efficiency of replacing devices or parts by dividing the process unit into a plurality of separable units to avoid unnecessary replacement of still usable devices or parts when a device or a part whose lifetime has expired is to be replaced, as well as to provide an image forming apparatus having such a process unit.

In the present invention, a unit housing can be divided into an upper housing and a lower housing, a photosensitive member unit is removable from the upper housing, and a developing device is removable from the lower housing.

A process unit of the present invention comprises: a unit housing including a downwardly opened upper housing and an upwardly opened lower housing, the upper housing and the lower housing being detachably coupled to define a space section; a photosensitive member unit detachably attached in the upper housing, the photosensitive member unit including at least a case, a photosensitive member attached in the case, and a charging device attached in the case and charging the photosensitive member; and a developing device detachably attached in the lower housing, the developing device including at least a toner case containing toner, and a developing roller attached in the toner case and applying the toner to the photosensitive member.

An image forming apparatus of the present invention comprises: an apparatus main body; and a process unit placed in the apparatus main body, wherein the process unit comprises: a unit housing including a downwardly opened upper housing and an upwardly opened lower housing, the upper housing and the lower housing being detachably coupled to define a space section; a photosensitive member unit detachably attached in the upper housing, the photosensitive member unit including at least a case, a photosensitive member attached in the case, and a charging device attached in the case and charging the photosensitive member; and a developing device detachably attached in the lower housing, the developing device including at least a toner case containing toner, and a developing roller attached in the toner case and supplying the toner to the photosensitive member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 12:
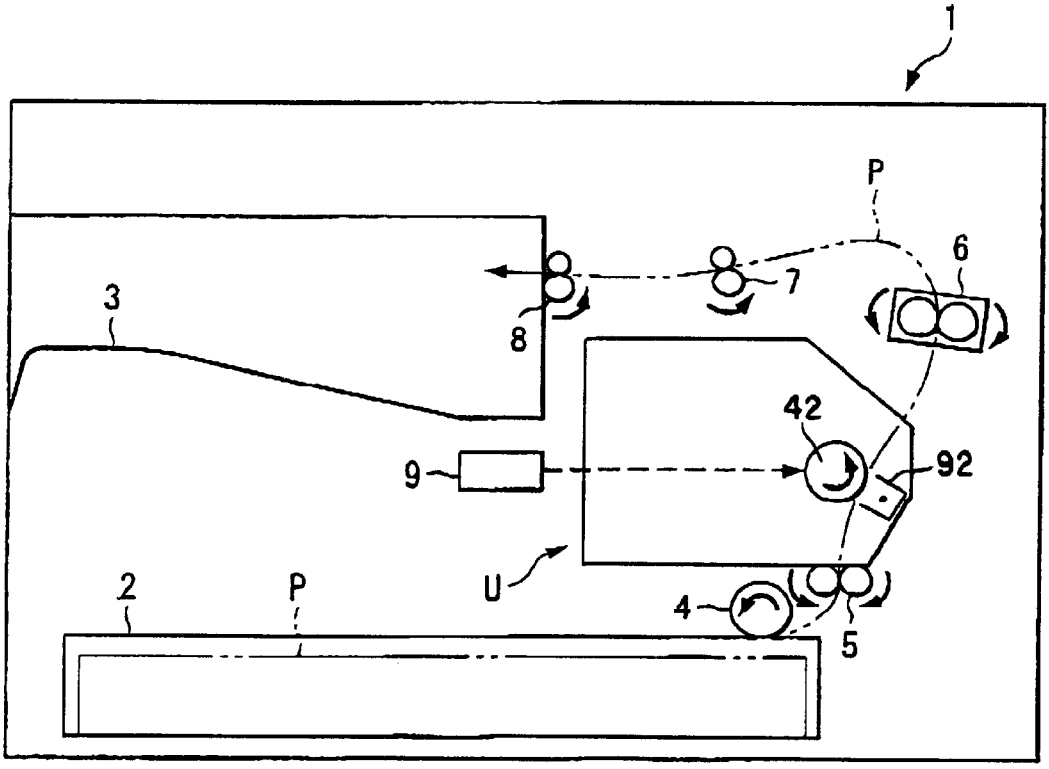
FIG. 12 schematically shows an image forming apparatus.

FIG. 12 shows an image forming apparatus. An apparatus main body 1 includes a process unit U in its middle part. The apparatus main body 1 has a paper feeding cassette 2 at its lower part. The paper feeding cassette 2 contains a stack of recording paper P. The apparatus main body 1 is provided with an output tray 3 at its upper part. In the apparatus main body 1, a paper feeding roller 4 and conveying rollers 5 are arranged below the process unit U, and a fixing device 6, conveying rollers 7 and output rollers 8 are arranged above the process unit U. The apparatus main body 1 includes an exposing device 9.

In the image forming apparatus, the paper feeding roller 4 feeds recording paper P one by one by rotating from the paper feeding cassette 2, and the conveying rollers 5 convey the paper P to the process unit U by rotating. The process unit U records an image during conveying the recording paper P upward from below. The fixing device 6 fixes a toner image on the recording paper P while conveying it. Furthermore, the conveying rollers 7 convey the recording paper P by rotating, and the output rollers 8 let the paper P out onto the output tray 3 by rotating.

The process unit U will now be described with reference to FIGS. 1–11.

Figure 1:
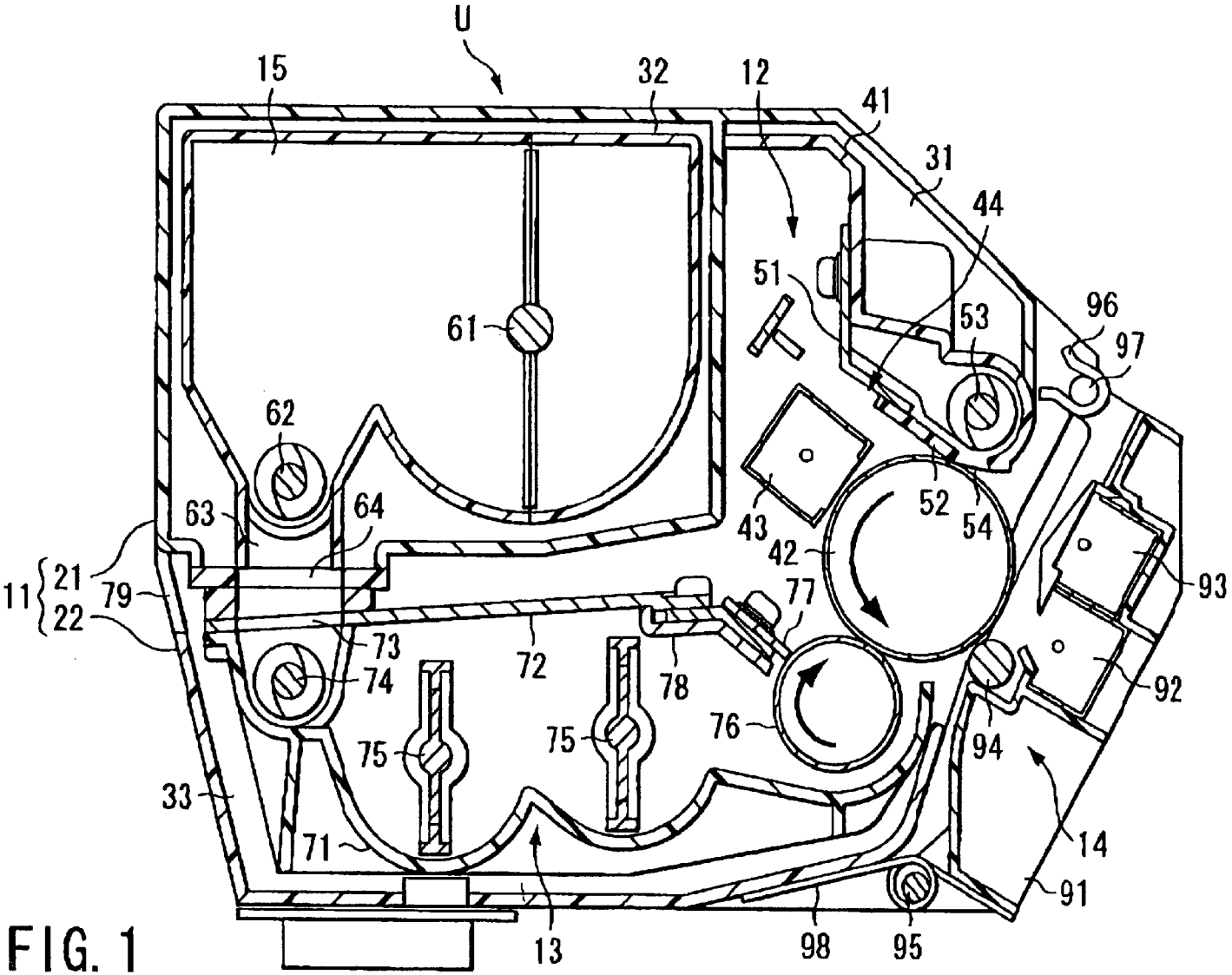
FIG. 1 is a cross-sectional view showing a process unit according to an embodiment of the present invention.
Figure 2:
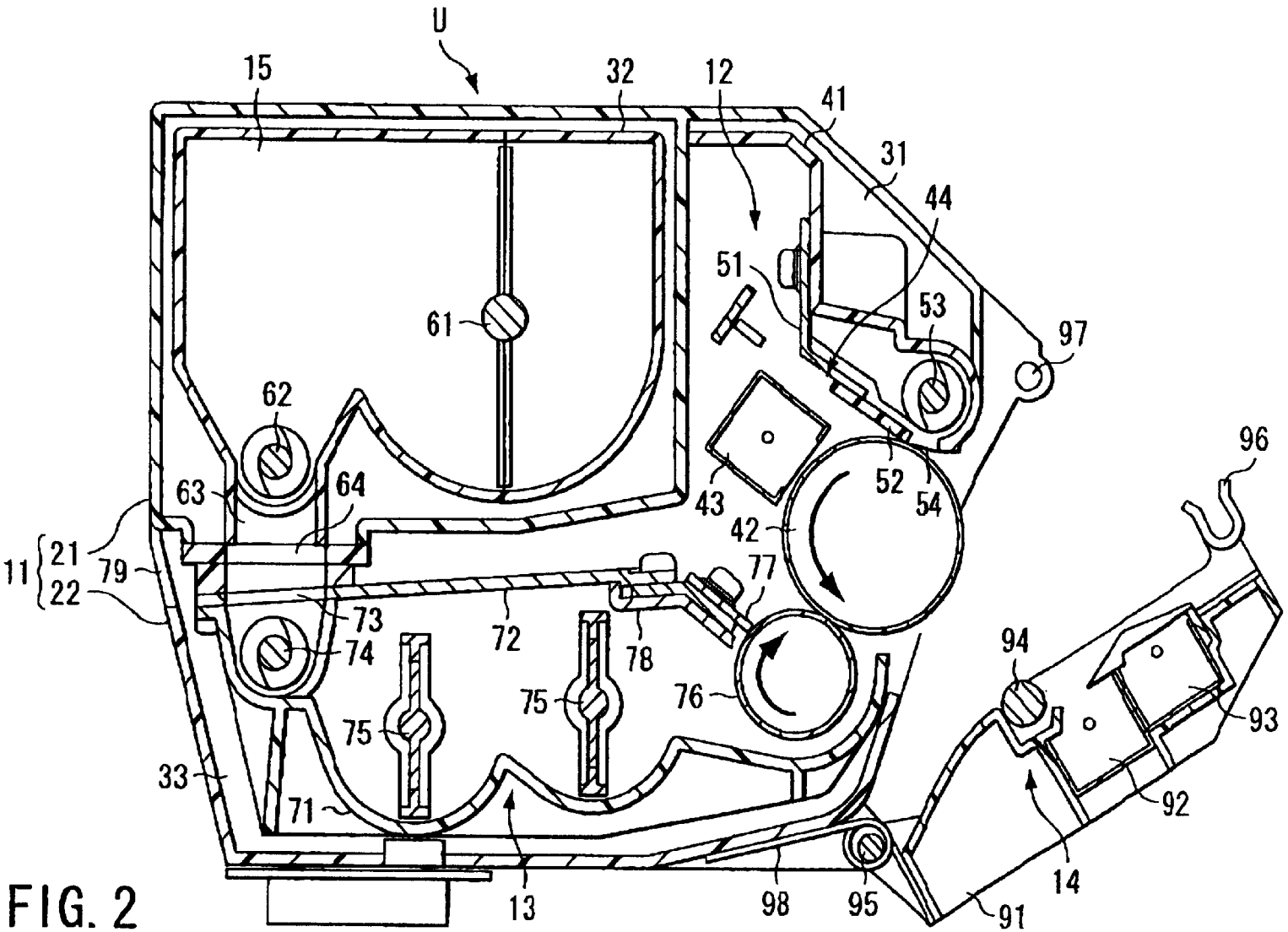
FIG. 2 is a cross-sectional view showing the process unit according to the embodiment.
Figure 3:
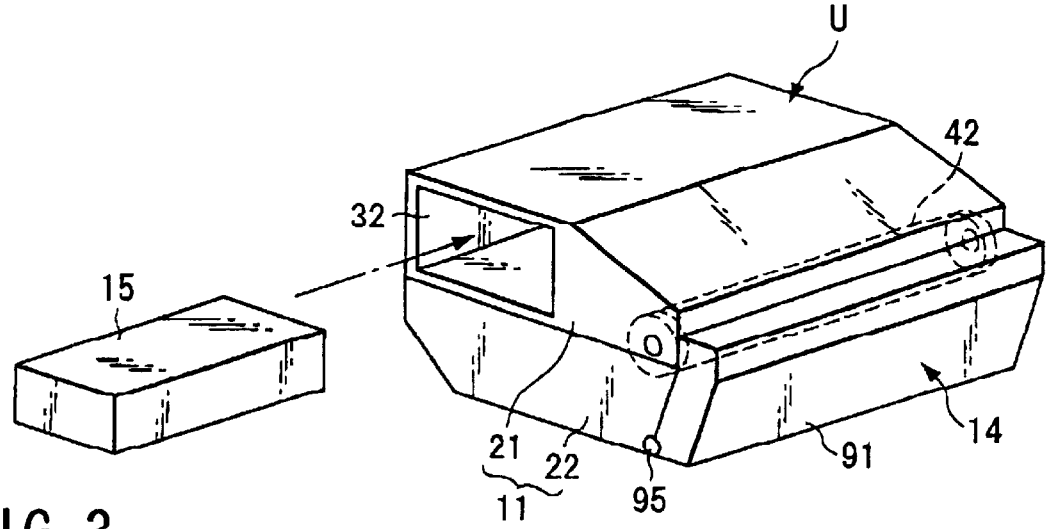
FIG. 3 is a perspective view showing an external appearance of the process unit according to the embodiment.
Figure 4:
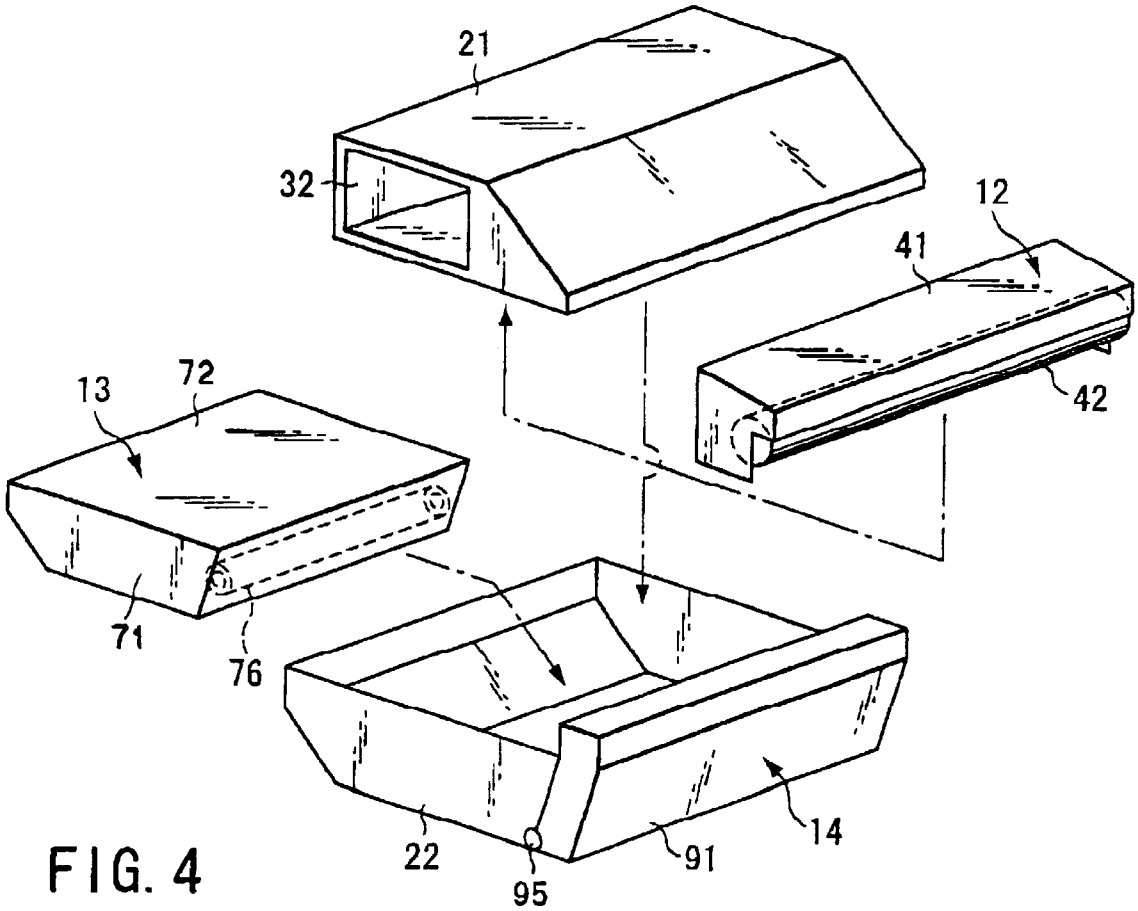
FIG. 4 is a perspective view showing a state in which the process unit according to the embodiment is disassembled into separate units.
Figure 5:
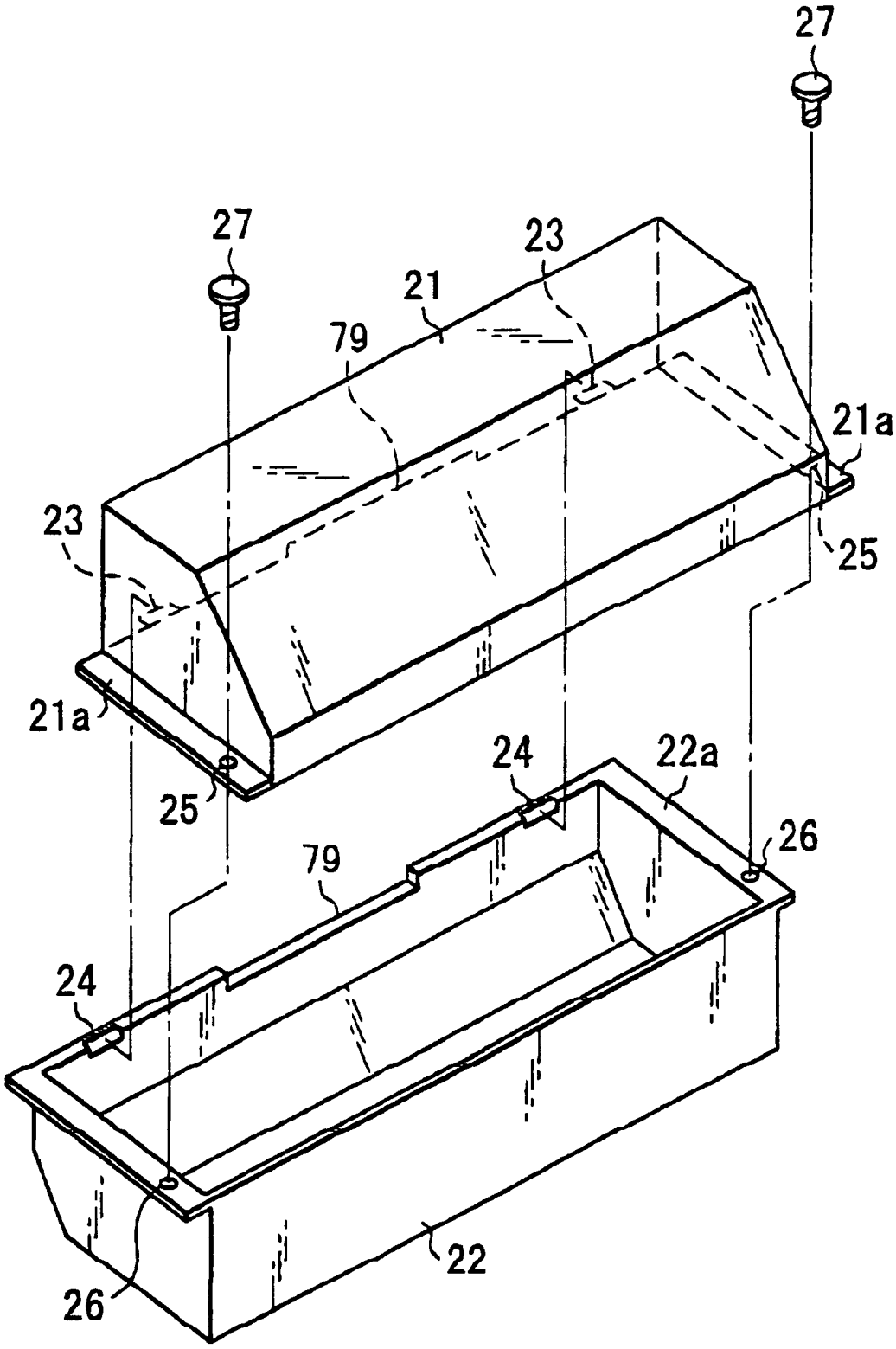
FIG. 5 is a perspective view showing a state in which a unit housing of the process unit according to the embodiment is disassembled.
Figure 6:
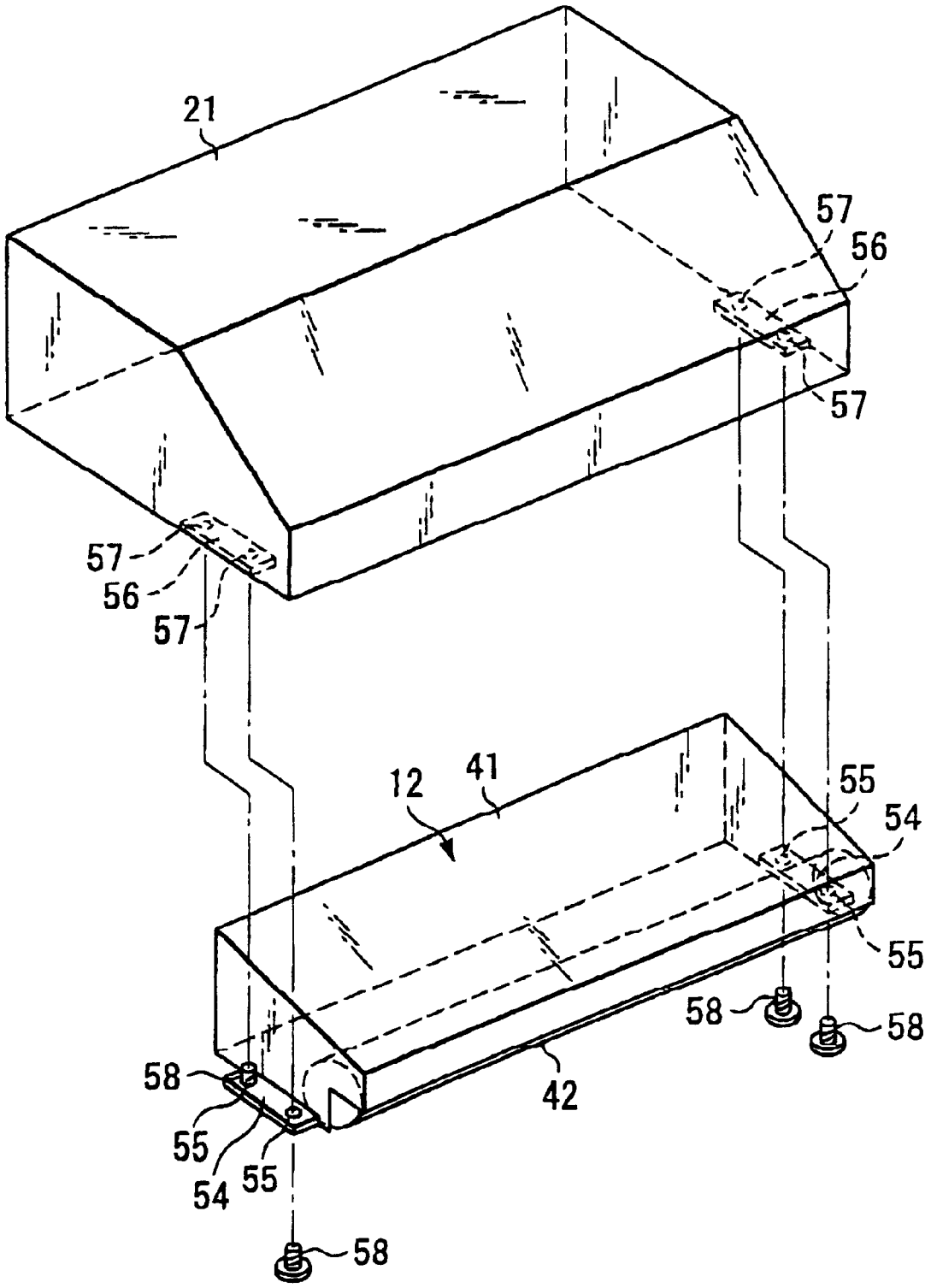
FIG. 6 is a perspective view showing a state in which the unit housing and a photosensitive member unit of the process unit according to the embodiment are disassembled.
Figure 10:
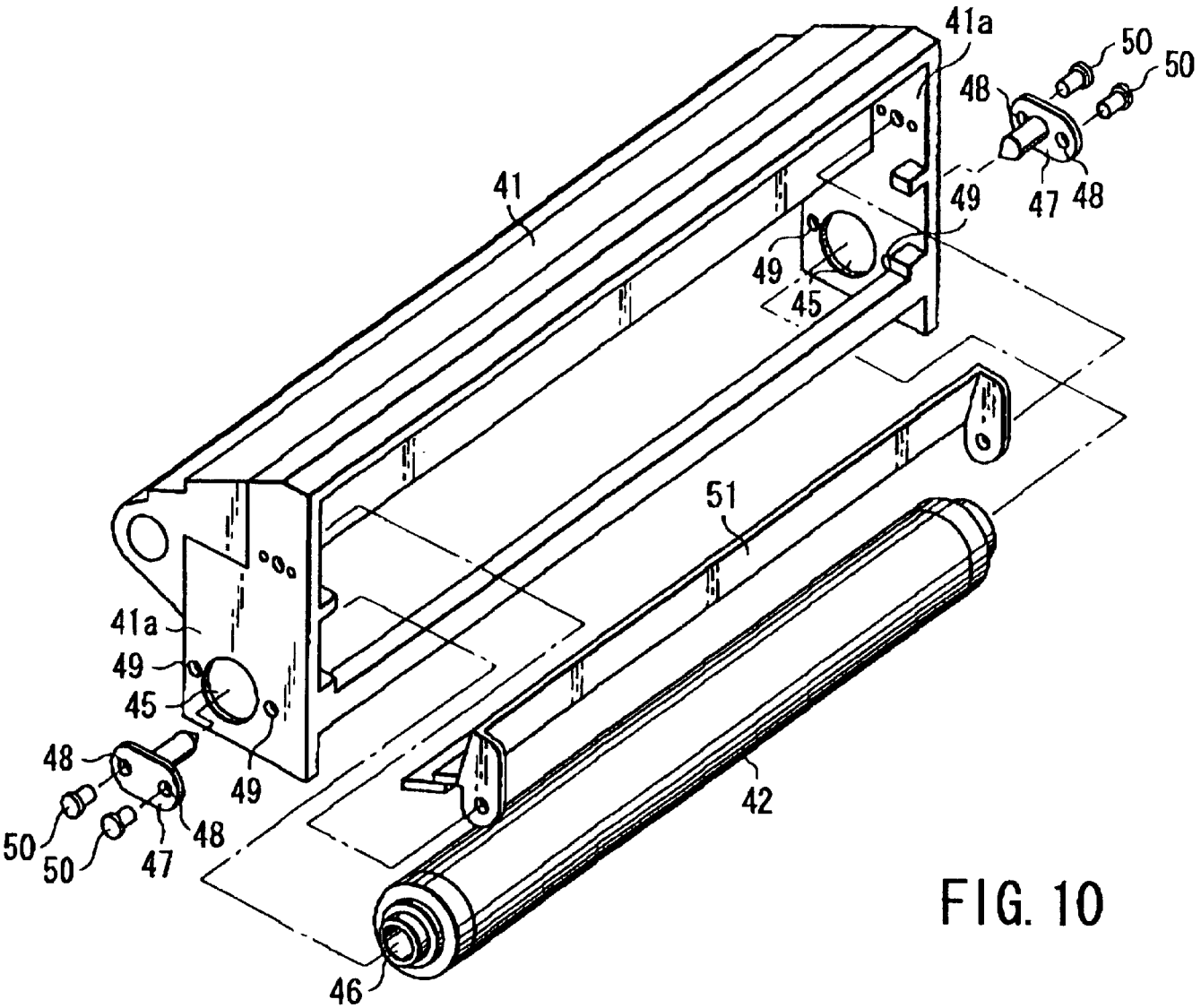
FIG. 10 is a perspective view showing a state in which the photosensitive member unit of the process unit according to the embodiment is disassembled.

FIGS. 1 and 2 are cross-sectional views showing the process unit U. FIG. 1 shows a closed condition of a transferring device unit, and FIG. 2 shows an opened condition of the transferring device unit. FIG. 3 is a perspective view showing an external appearance of the process unit. FIG. 4 is a perspective view showing a state in which the process unit is disassembled into units. FIG. 5 is a perspective view showing a state in which a unit housing is disassembled. FIG. 6 is a perspective view showing a state in which the unit housing and a photosensitive member unit are disassembled. FIG. 10 is a perspective view showing a state in which the photosensitive member unit is disassembled.

The process unit U comprises a unit housing 11, a photosensitive member unit 12, a developing device 13, a transferring device unit 14 and a toner cartridge 15.

The unit housing 11 is formed by combining an upper housing 21 and a lower housing 22, and has a space inside of the unit housing 11. A bottom face of the upper housing 21 is opened, and the upper housing 21 has a flange 21*a* surrounding the opened part, as shown in FIG. 5. A top face of the lower housing 22 is opened, and the lower housing 22 has a flange 22*a* surrounding the opened part, as shown in FIG. 5. The opened part of the upper housing 21 and the opened part of the lower housing 22 are opposed to each other, and the flange 21*a* of upper housing 21 and the flange 22*a* of lower housing 22 are abutted against each other. For example, the flange 21*a* has projections 23, and the flange 22*a* has recesses 24 for engaging with the projections 23. The projections 23 and recesses 24 fix the position of the upper housing 21 and lower housing 22. Holes 25 are formed in the flange 21*a*, and tapped holes 26 are formed in the flange 22*a*. Screws 27 are passed through the holes 25 and tapped holes 26, and detachably join the upper housing 21 and lower housing 22.

The upper housing 21 includes a horizontally elongated space section 31 for containing the photosensitive member unit 12 and a horizontally elongated chamber 32 for containing the toner cartridge 15 in parallel. The photosensitive member unit 12 comprises a case 41, a photosensitive drum 42, a charging device 43 and a cleaning blade 44. The case 41 is horizontally elongated and has both end portions 41*a* where are formed shaft holes 45, respectively as shown in FIG. 10. The photosensitive drum 42 is for forming an image on its surface, and it is attached to a drum shaft 46. The photosensitive drum 42 is placed within the case 41 along the longitudinal direction of the case 41. Both end portions of the drum shaft 46 are inserted in the shaft holes 45 in the case 41. Each of a pair of support members 47 has holes 48, and each of the end portions 41*a* of case 41 has tapped holes 49. Screws 50 are passed through the holes 48 to tapped holes 49. Thereby, the paired support members 47 are attached to the end portions 41*a* of case 41. The paired support members 47 are inserted in the shaft holes 45 in the case 41 and rotatably support both end portions of the drum shaft 46. Thus, the photosensitive drum 42 is detachably attached to the case 41.

The apparatus main body 1 of the image forming apparatus is equipped with a drive mechanism (not shown), which makes the drum shaft 46 rotate in the direction of an arrow in FIG. 1.

The charging device 43 is for electrifying the surface of the photosensitive drum 42 by a method using a corona discharge. The charging device 43 has the same length as the photosensitive drum 42. The charging device 43 is placed above the photosensitive drum 42 in parallel to the photosensitive drum 42. The charging device 43 is detachably attached to both end portions of the case 41 by means of screws (not shown).

The cleaning blade 44 is for removing toner remaining on the surface of the photosensitive drum 42 after the toner image on the surface of the photosensitive drum 42 has been transferred on a recording paper. The cleaning blade 44 comprises a holder 51 and a blade 52 attached to the holder 51. The cleaning blade 44 is attached adjacent to the upstream side from the charging device 43 in the rotational direction of the photosensitive drum 42. The cleaning blade 44 is detachably attached to both end portions of case 41 by means of screws (not shown).

A screw 53 for eliminating toner conveys the residual toner scraped off by the cleaning blade 44 from the photosensitive drum 42 to the outside of the case 41 by rotating. The screw 53 is arranged in the case 41 in parallel with the cleaning blade 44.

The photosensitive member unit 12 is placed in the space section 31 of upper housing 21 and attached to the upper housing 21. Extending projections 54 are outwardly formed on both end portions of the case 41 respectively, and holes 55 are formed in each projection 54 as show in FIG. 6. Extending projections 56 are inwardly formed on the upper housing 21. Tapped holes 57 are formed in each projection 56. Both projections 54 and 56 are set on each other in the vertical direction, and screws 58 are passed through the holes 55 and tapped holes 57. With this structure, the case 41 is attached to the upper housing 21.

The chamber 32 of upper housing 21 is tubular shaped with a quadrangular cross section. One end portion of the chamber 32 is opened. The toner cartridge 15 contains toner and has a toner outlet 63 formed at one end portion of the bottom. The toner cartridge 15 includes a stirrer 61 for stirring the toner, and a convey screw 62 for conveying the toner to the toner outlet 63. The toner cartridge 15 can be inserted in, and extracted out of, the chamber 32 via the opening portion.

Figure 7:
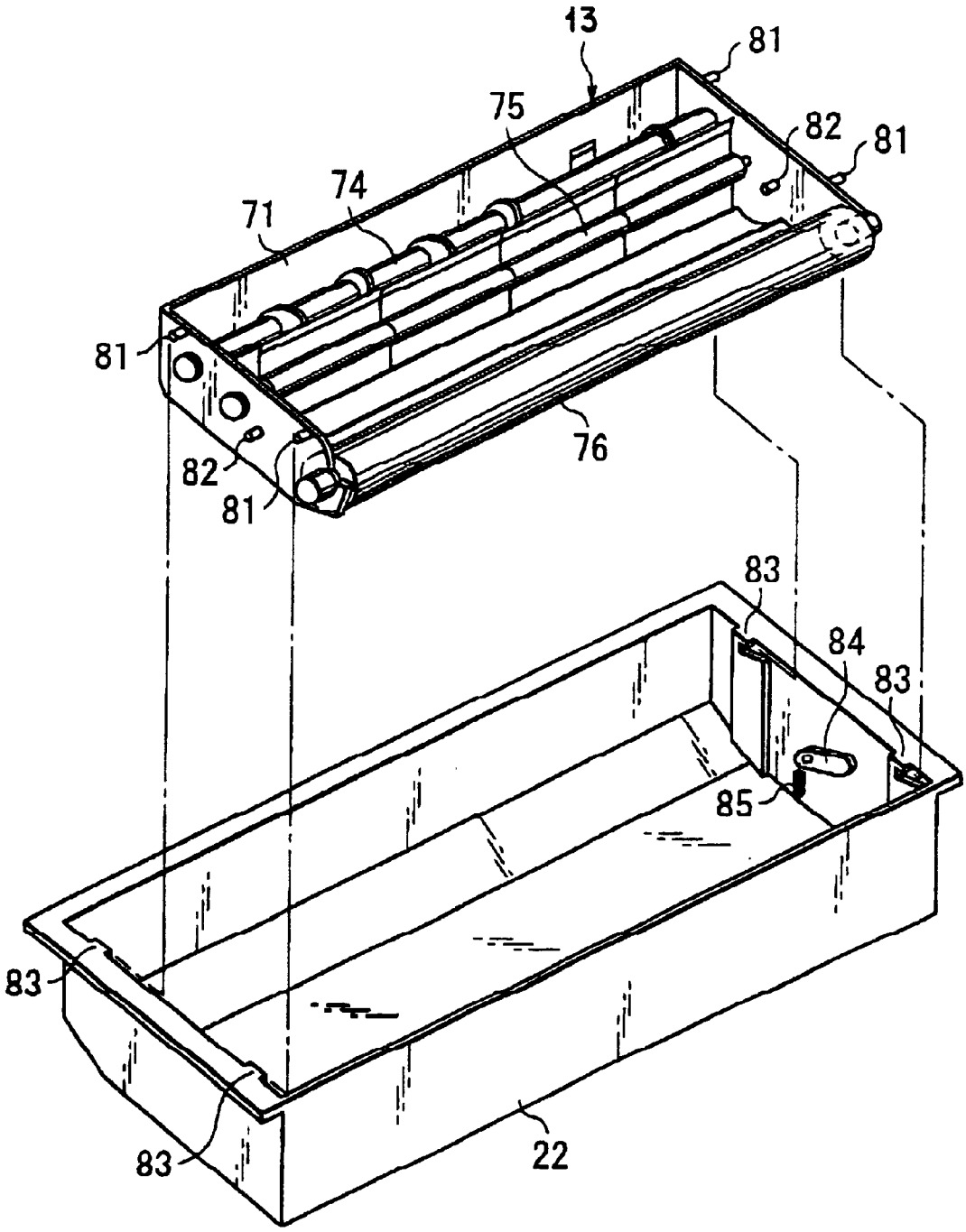
FIG. 7 is a perspective view showing a state in which the unit housing and a developing device of the process unit according to the embodiment are disassembled.
Figure 8:
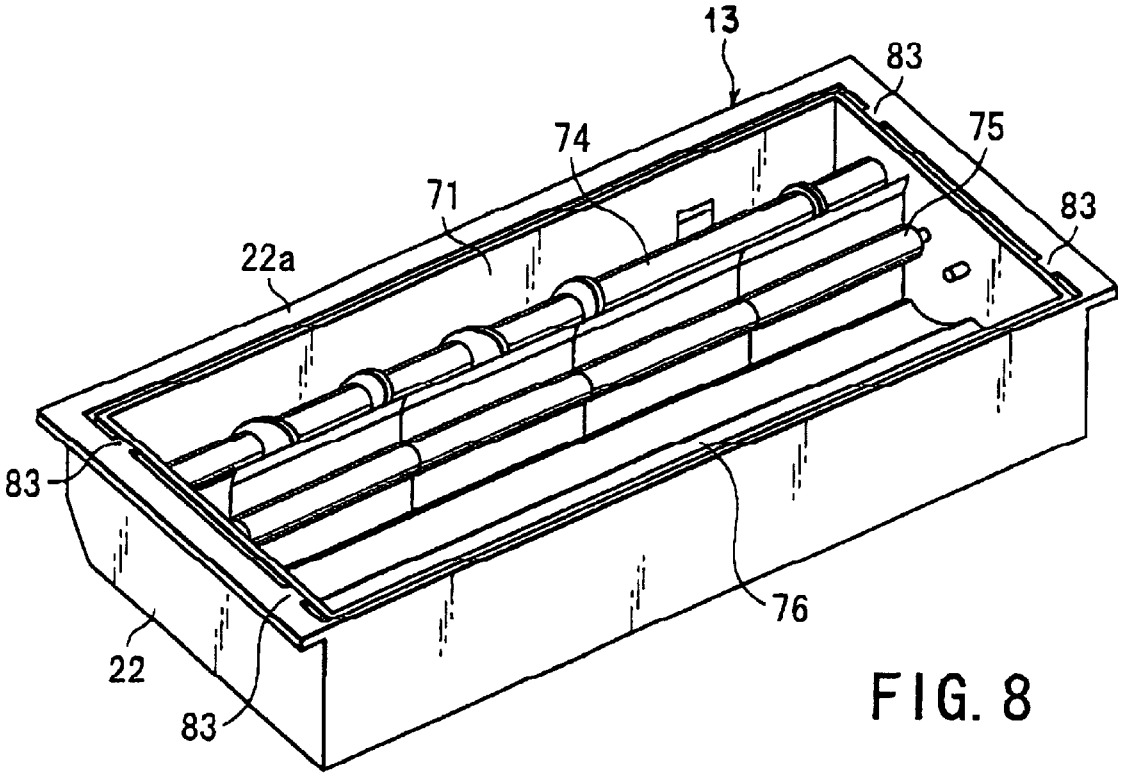
FIG. 8 is a perspective view showing a state in which the developing device is attached to the unit housing of the process unit according to the embodiment.
Figure 9:
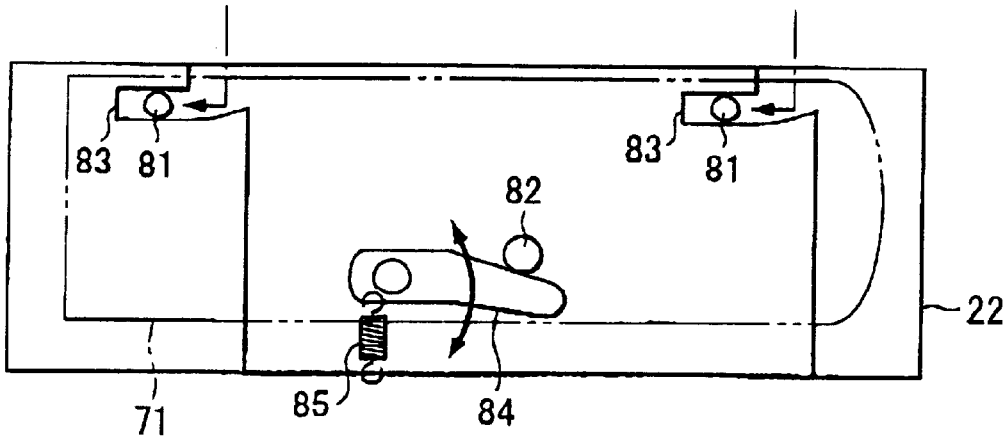
FIG. 9 shows a structure for attaching the developing device to the unit housing of the process unit according to the embodiment.
Figure 11:
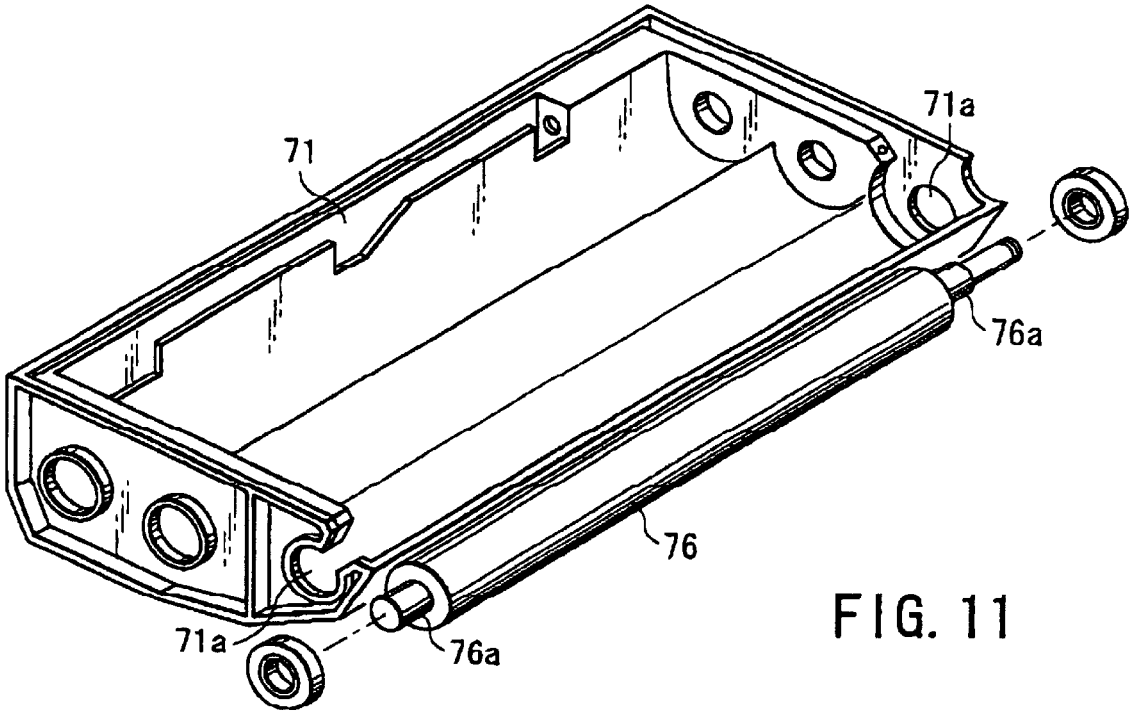
FIG. 11 is a perspective view showing a state in which the developing device of the process unit according to the embodiment is disassembled.

The lower housing 22 has a space section 33 inside. The developing device 13 is placed in the space section 33. FIG. 7 shows a state in which the lower housing 22 and the developing device 13 are separated. FIG. 8 shows a state in which the lower housing 22 and the developing device 13 are assembled. FIG. 9 shows a structure for coupling the lower housing 22 and developing device 13. FIG. 11 shows the case of the developing device 13 and a developing roller 76.

The developing device 13 has a toner case 71 and a cover 72. The toner case 71 is for storing toner and an upper end thereof is opened. The cover 72 covers the upper-end opening of the toner case 71 and is detachably attached to the toner case 71 by means of screws (not shown). The cover 72 opens a portion which locates the lower side of the photosensitive drum 42 corresponding to the opening portion of the toner case 71. The cover 72 has a toner inlet 73. The cover 72 is provided with a packing 64. When the toner cartridge 15 is inserted in the chamber 32, the packing 64 is placed on, and coupled to the toner outlet 63 of the toner cartridge 15. Thus, the toner conveyed to the toner outlet 63 flows into the toner inlet 73 via the packing 64 and further flows into the toner case 71 through the toner inlet 73.

A toner conveying screw 74 is placed in the toner case 71 below the toner inlet 73. In addition, two stirrers 75 and a developing roller 76 are arranged below the photosensitive drum 42. The toner conveying screw 74, two stirrers 75 and developing roller 76 are arranged in parallel to the photosensitive drum 42 and are rotatably attached to the toner case 71. For example, as shown in FIG. 11, the developing roller 76 is attached to a shaft 76*a*. Both end portions of the shaft 76*a* are inserted and supported in holes 71*a* formed at both side portions of the toner case 71. One of the holes 71*a* permits the end portion of the developing roller 76 to insert into, and to extract from, by having a gate. Thus, the developing roller 76 is detachably attached.

The toner conveying screw 74, two stirrers 75 and developing roller 76 are respectively driven by driving mechanisms (not shown) provided in the apparatus main body 1. The toner conveying screw 74 conveys the toner coming in the toner case 71 into the central area of the toner case 71. The stirrers 75 stir the toner and conveys it to the developing roller 76. The developing roller 76 is exposed from an opening portion of the toner case 71, and is in contact with the photosensitive drum 42 from a position lower than the photosensitive drum 42. The developing roller 76 forms a toner image on the photosensitive drum 42 by supplying toner to the photosensitive drum 42 and developing a latent image. A toner limiter 77 contacts the developing roller 76, and a holder 78 attaches the toner limiter 77 to the cover 72.

A window 79 is formed at a connected portion between the upper housing 21 and lower housing 22. The window 79 lets a light beam from the exposing device 9 strike upon the photosensitive drum 42. A latent image is formed on the exposed photosensitive drum 42 by the light beam.

The developing device 13 is inserted in the lower housing 22 from its opening portion and is attached to the lower housing 22 by a mechanism to be described with reference to FIGS. 7 to 9. The toner case 71 has a pair of pins 81, or second hook portions, extending outward from each of both side portions thereof, and an operation pin 82 extending outward between the paired pins 81. A pair of hook grooves 83, or first hook portions, are provided at each of the side portions of the lower housing 22. The hook grooves 83 extend in a direction perpendicular to the axial direction of the photosensitive drum 42, and one end of each groove is opened. The toner case 71 is moved downward in the opening portion of the lower housing 22, and then it is moved in a direction perpendicular to the axial direction of the photosensitive drum 42. Thus, the paired pins 81 are inserted and engaged in the paired hook grooves 83. This prevents the toner case 71 from being extracted from the lower housing 22.

Each of both side portions of the lower housing 22 has a lever 84 and a tension coil spring 85 situated between the paired hook grooves 83. The lever 84 is configured to be vertically rotatable. The tension coil spring 85 exerts force on the lever 84 in its rotational direction. When the toner case 71 is lowered in the opening portion of the lower housing 22, the operation pins 82 abut upon the levers 84 and urge them downward against the force of the tension coil springs 85. The levers 84 receive the force of the tension coil springs 85 and apply an upward force to the operation pins 82. As the pins 81 are pressed in the grooves 83, the toner case 71 is firmly held in the lower housing 22. By carrying out the reverse operations, the toner case 71 can easily be extracted from the lower housing 22.

The transferring device unit 14 is attached facing the photosensitive drum 42 on the outside of the unit housing 11 as shown in FIGS. 1 to 4. The transferring device 14 comprises a holder 91, a transferring device 92, a corona discharging device 93 for peeling a recording paper, and a guide roller 94. The transferring device 92, the corona discharging device 93 for peeling a recording paper and the guide roller 94 are attached to the holder 91 and cooperate with the photosensitive drum 42 to constitute a conveying path for clamping and passing a recording paper.

The holder 91 is attached to the lower housing 22 by means of a rotational shaft 95 at a lower end portion. The holder 91 is attached rotatable on the rotational shaft 95 so as to move in directions toward and away from (directions of closing and opening) the unit housing 11 and photosensitive drum 42. An upper end portion of the holder 91 has a lock member 96, and the upper housing 21 has a pin 97 to be engaged to the lock member 96. When the holder 91 approaches the unit housing 11 and is set in the closed position, the lock member 96 maintains the holder 91 in a closed condition by being engaged to the pin 97. A torsion coil spring 98 is supported on the rotational shaft 95. This spring 98 exerts force on the holder 91 in a direction toward the lower housing 22.

The transferring device 92 is placed facing the photosensitive drum 42, and transfers a toner image on the photosensitive drum 42 onto a recording paper P by applying a corona discharge. The corona discharging device 93 peels the toner image off from the photosensitive drum 42 by charging a voltage to the recording paper P. The guide roller 94 guides the recording paper P to the transferring device 92.

Accordingly, when the holder 91 is opened, the condition of the transferring device 92 can be watched. In addition, a recording paper P, which had jammed between the photosensitive drum 42 and transferring device 92, can be taken out.

Because the unit housing 11 is constructed by detachably assembling the upper housing 21 and lower housing 22, the process unit U can easily be disassembled at the unit housing 11 by separating the upper housing 21 and lower housing 22. Since the photosensitive member unit 12 is detachably attached to the upper housing 21, the photosensitive member unit 12 can easily be taken off from the upper housing 21. Since the developing device 13 is detachably attached to the lower housing 22, the developing device 13 can easily be taken off from the lower housing 22. Therefore, when the lifetime of a consumable component, e.g. photosensitive drum 42, has expired and replacement is required, it can be replaced by taking the photosensitive member unit 12 off from the process unit U and putting the photosensitive drum 42 off from the photosensitive member unit 12. It is possible to replace only the component of the process unit which needs to be replaced, and to use continuously the components whose lifetime has not expired. Generally, when the component is replaced, a service technician of the maker takes back the photosensitive member unit 12 from the user and replaces the component at the maker. In this case, the replacement of the component is quickly performed by using a component of a photo sensitive member unit 12 taken back from another user.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A process unit comprising:

a unit housing including a downwardly opened upper housing and an upwardly opened lower housing, the upper housing and the lower housing being detachably coupled to define a space section;

a photosensitive member unit detachably attached in the upper housing, the photosensitive member unit including at least a case, a photosensitive member attached in the case, and a charging device attached in the case and charging the photosensitive member; and a developing device detachably attached in the lower housing, the developing device including at least a toner case containing toner, and a developing roller is attached to the toner case and supplying the toner to the photosensitive member.

2. A process unit according to claim 1, wherein the unit housing further comprises a transferring device unit, the transferring device unit including a holder rotatable in directions toward and away from the photosensitive member, and a transferring device attached on the holder and transferring a toner image on the photosensitive member onto a recording paper.

3. A process unit according to claim 1, wherein a toner cartridge which supplies the toner to the toner case of the developing device is detachably attached in the upper housing.

4. A process unit according to claim 1, wherein the upper housing and the lower housing are coupled by using a screw.

5. A process unit according to claim 1, wherein the case of the photosensitive member unit is attached to the upper housing by using a screw.

6. A process unit according to claim 1, wherein the lower housing has a first hook portion and the toner case has a second hook portion to be hooked with the first hook portion when the toner case is placed inside the lower housing.

7. An image forming apparatus comprising:

an apparatus main body; and a process unit placed in the apparatus main body, wherein the process unit comprises:

a unit housing including a downwardly opened upper housing and an upwardly opened lower housing, the upper housing and the lower housing being detachably coupled to define a space section;

a photosensitive member unit detachably attached in the upper housing, the photosensitive member unit including at least a case, a photosensitive member attached in the case, and a charging device attached in the case and charging the photosensitive member; and a developing device detachably attached in the lower housing, the developing device including at least a toner case containing toner, and a developing roller attached in the toner case and supplying the toner to the photosensitive member.

* * * * *